US007083528B2

(12) United States Patent
Marland et al.

(10) Patent No.: US 7,083,528 B2
(45) Date of Patent: Aug. 1, 2006

(54) GOLF SWING IMPROVING AID

(75) Inventors: Michael Wilson Marland, Epson (GB); Deborah Jane Inman, Epson (GB)

(73) Assignee: Marinman Associates Limited, Surrey (GB)

( * ) Notice: Subject to any disclaimer, the term of this patent is extended or adjusted under 35 U.S.C. 154(b) by 224 days.

(21) Appl. No.: 10/770,112

(22) Filed: Feb. 2, 2004

(65) Prior Publication Data

US 2006/0003850 A1 Jan. 5, 2006

Related U.S. Application Data

(63) Continuation of application No. 09/674,184, filed on Oct. 27, 2000, now abandoned.

(51) Int. Cl.
*A63B 69/36* (2006.01)

(52) U.S. Cl. ..... 473/276; 473/212; 473/226

(58) Field of Classification Search ..... 473/206–208, 473/212–229, 266, 276; D21/791
See application file for complete search history.

(56) References Cited

U.S. PATENT DOCUMENTS

| | | | | |
|---|---|---|---|---|
| 1,962,256 | A | 6/1934 | Nelson et al. | |
| 2,022,910 | A | 12/1935 | Hanley | |
| 3,679,214 | A | 7/1972 | Boyte | |
| 4,150,821 | A * | 4/1979 | Racz | 473/464 |
| 4,662,640 | A * | 5/1987 | Grander | 473/215 |
| 5,150,901 | A | 9/1992 | Stawicki | |
| 5,174,575 | A | 12/1992 | Leith et al. | |
| 5,203,570 | A | 4/1993 | Graham | |
| 5,441,271 | A | 8/1995 | Briggs | |
| 5,451,060 | A | 9/1995 | Balbo | |
| 5,501,464 | A | 3/1996 | Dalbo | |
| D372,064 | S * | 7/1996 | del Barrio | D21/791 |
| 5,688,184 | A | 11/1997 | Johnson | |
| 5,795,238 | A | 8/1998 | Nicholson | |
| 5,893,803 | A | 4/1999 | Leadbetter et al. | |
| 6,827,654 | B1 * | 12/2004 | Meyer | 473/212 |

* cited by examiner

*Primary Examiner*—Nini F. Legesse
(74) *Attorney, Agent, or Firm*—Renner, Otto, Boisselle & Sklar, LLP

(57) ABSTRACT

An aid for helping a golfer to improve his swing in which an arm-mountable harness (11, 12) links the handle of a golf club (13), in use, to the elbow of the golfer's secondary club driving arm in a manner which enables the golfer to grip the club-handle (13) with his primary driving arm and, having then temporarily stabilised the position of his secondary arm with respect to his upper body, impact the club head against a waiting ball in an otherwise conventional one-handed swing during which the elbow-to-club link of the harness replaces the forearm of his secondary arm.

6 Claims, 2 Drawing Sheets

GOLF SWING IMPROVING AID

This application is a continuation of U.S. patent application Ser. No. 09/674,184 filed on Oct. 27, 2000, which is hereby incorporated herein by reference in its entirety.

FIELD OF THE INVENTION

The invention relates to aids for helping a golfer to improve his swing.

BACKGROUND ART KNOWN TO THE APPLICANT

A number of documents have disclosed harnesses designed to help the golfer improve his swing. For example, U.S. Pat. No. 5,451,060 (DALBO) discloses a harness which extends around the shoulders of the golfer. U.S. Pat. No. 5,795,238, (NICHOLSON), discloses training apparatus, for developing muscle memory relative to a golf stroke, which connects the golfer's secondary arm to the fingers of his primary arm via a shoulder portion. Additionally, U.S. Pat. No. 5,188,365 (PICARD) discloses a golf-swing training harness, which in use connects the arms, waist and leading leg of the golfer to ensure good co-ordination between these body parts.

Also known to the Applicant are U.S. Pat. No. 5,174,575 (LEITH) and U.S. Pat. No. 1,962,256 (NELSON) which show harness-based golf training aids.

Of particular relevance is U.S. Pat. No. 2,022,910 (HANLEY) which discloses a device, which in its preferred form trains and assists the golfer to cock the wrist of his secondary arm at the correct time and in the correct manner. This is achieved by connecting the hand of the secondary arm to its elbow via an elastic member.

SUMMARY OF THE INVENTION

In its broadest aspect the invention is embodied in an aid for helping a golfer to improve his swing in which an arm-mountable harness links the handle of a golf club, in use, to the elbow of the golfer's secondary club-driving arm in a manner which enables the golfer to grip the club handle with his primary driving arm and, having then temporarily stabilised the position of his secondary arm with respect to his upper body, impact the club head against a waiting ball in an otherwise conventional one-handed swing during which the elbow-to-club link of the harness replaces the forearm of his secondary arm.

The harness may comprise a glove into which the golfer places the hand of his primary driving arm prior to gripping the club, the glove thereby linking the handle to his elbow in the manner specified.

The club handle may be foreshortened by an amount approximately equal to the distance the four fingers of the golfer's secondary hand would occupy on the handle were he to grip the handle conventionally with both hands prior to swinging the club.

In such an arrangement, the club may form part of the aid, but in the broadest aspect of the invention the club is of course optional.

Preferably also the elbow-to-club link provided by the harness is a non-rigid link.

In the case just outlined, the non-rigid link may comprise a loop of relatively lightweight material such as webbing or the like.

In any arrangement embodying the invention, the elbow-to-club link provided by the harness may be adjustable to accommodate golfers of differing height and. in particular, where that link comprises a loop as just outlined, the loop may take the form of a length-adjustable belt.

In this specification the primary driving arm of a player playing right-handed is his right arm, and the primary driving arm of a player playing left-handed is his left arm.

In use of the invention therefore, a golfer playing right-handed will mount the harness on his left arm to link his left elbow to the club in use and will grip the club handle with his right hand and, having temporarily stabilised the position of his left arm with respect to his upper body, will swing the club head against the waiting ball with his right arm in an otherwise conventional one-handed golf swing during which the elbow-to-club link of the harness replaces the forearm of his left arm.

The converse of this summary will apply for a left-handed golfer.

DESCRIPTION OF THE CURRENTLY PREFERRED EMBODIMENT WITH REFERENCE TO THE ACCOMPANYING DRAWINGS

In the drawings accompanying this text and forming part of the disclosure of this patent specification:

Figure 1:
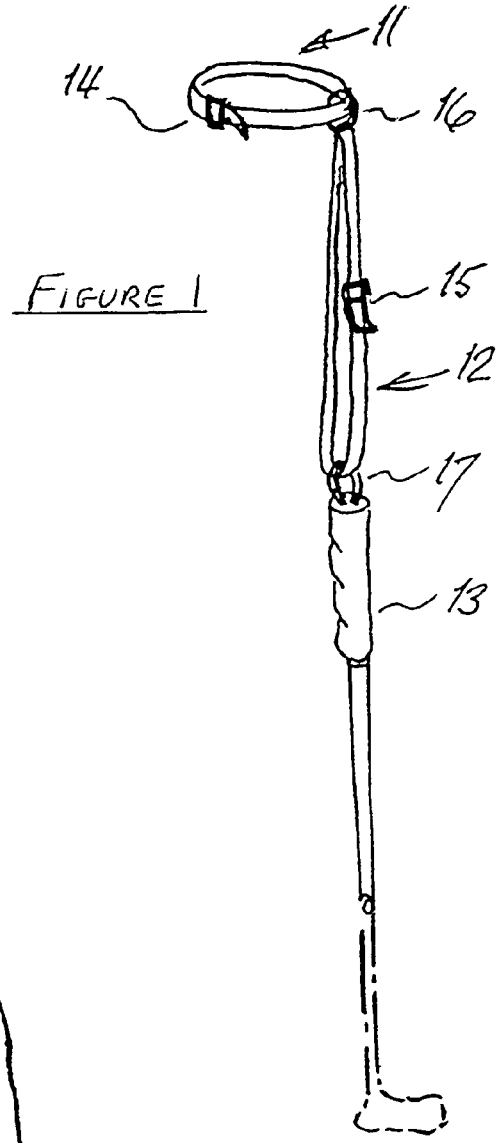
FIG. 1 shows an aid embodying the invention.

The aid illustrated comprises a harness fixed to the foreshortened handle of a golf club. The harness is in two parts referenced respectively 11 and 12. The club is an iron driver with its handle 13 attached to the part 12 of the harness at the handleend. The details of the club shaft and head are otherwise conventional and form no essential feature of the invention.

Each of the two parts 11 and 12 of the harness comprises a length-adjustable belt of webbing or similarly relatively lightweight but strong material. The belts have respective buckles 14,15 which enable them to be adjusted for length overall. The webbing material can be selected from known alternatives but, once lengthadjusted to suit the needs of the golfer in a particular situation, the buckles 14,15 maintain the respective overall belt lengths constant.

To that latter end, whilst the belt 11 may be made of a material having a limited degree of stretch, the belt 12 is made of webbing or other material which is inherently inextensible.

Loops 16,17 secure the belt 11 to the belt 12, and the belt 12 to the end of the club handle 13, respectively. The relative sliding fit between the components is such that the whole harness is easily twistable at its loop (16,17) regions but this is primarily for the purpose of giving an easy feel and fit to the golfer when he dons the harness and uses the aid. It is not necessarily a prerequisite of the invention.

Figure 2:
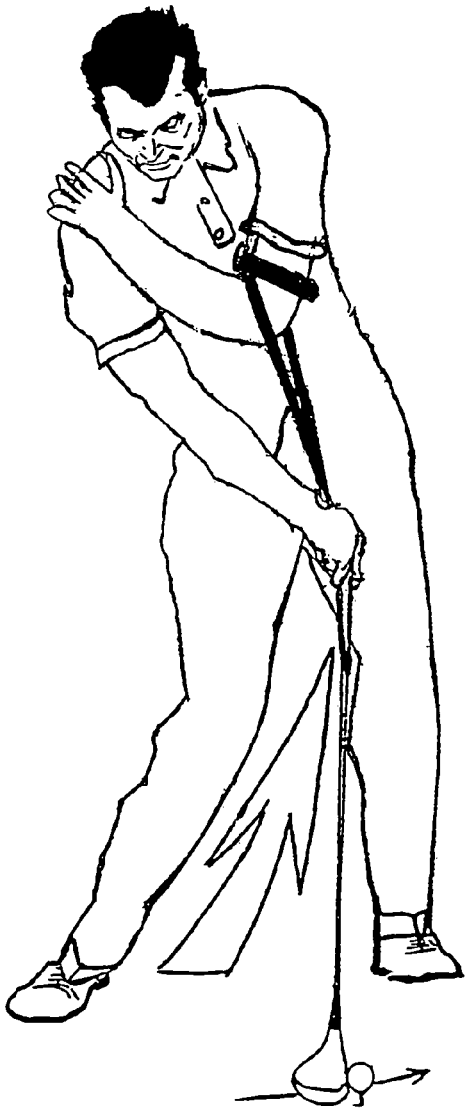
FIG. 2 shows the aid shown in FIG. 1 in use, by a player playing right-handed.

In use, and referring now to FIG. 2, a golfer playing right-handed straps the belt 11 onto his left upper arm just above the elbow joint of that arm, so that the loop 16 rests at the elbow joint. As he is playing right-handed and will strap the harness on to the upper arm region of his left arm, he tightens the belt via buckle 14 until loop 16 is firmly located at his left elbow.

He will then as necessary adjust the overall length of belt 12, using buckle 15, such that when he grasps the foreshortened club handle 13 with his right hand and takes up the conventional ball-addressing position on the practice tee, the elbow-to-club link provided by the extended taut belt 12 effectively replaces the forearm of his secondary arm as he impacts the club against the waiting ball in an otherwise conventional one-handed swing.

Classically golfers are taught that during the swing, and especially as the club head impacts against the ball, the left arm (in this case) should remain straight. The golfer will adjust the taut length of belt 12 accordingly. For the same purpose, whilst belt 11 may incorporate a certain amount of inherent stretch if necessary or desirable, belt 12 is ideally made of a material with substantially no inherent stretch.

To use the aid successfully, having donned the harness as described, the golfer must then temporarily stabilise the position of his left arm with respect to his upper body. As illustrated in FIG. 2, he does this by bringing his left arm across his chest and grasps his right shoulder with the palm and digits of his left hand. This flattens his left forearm against his chest and, as he maintains his grip, his left forearm will move with his upper body during the back swing and down swing he is about to execute but it will not essentially move relative to the upper body. His left elbow will therefore be similarly held in position automatically throughout the back swing and down swing movements.

The club handle itself is foreshortened as previously outlined. An otherwise conventionally long handle 13 is reduced in length by approximately the amount the four fingers of the golfer's left hand (in this instance) would occupy if he were to grip the club handle with both hands preparatory to a conventional ball impacting swing.

When he does grip the foreshortened club handle with his right hand, therefore, in use of the aid, he is effectively grasping the end region of the handle length with that hand.

Figure 3:
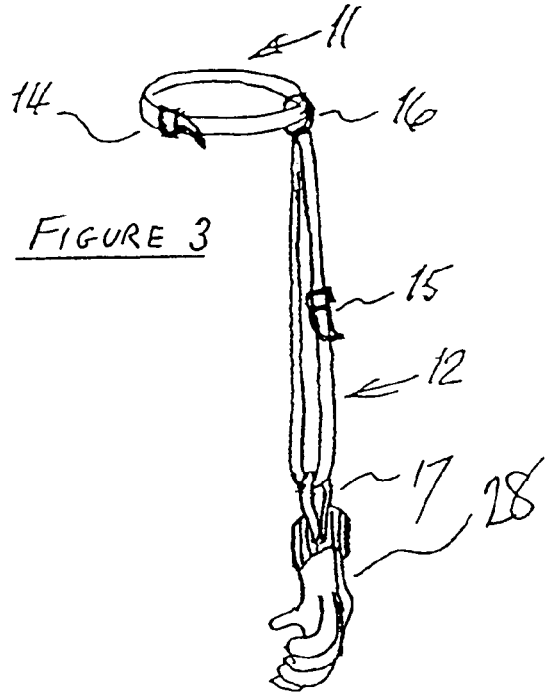
FIG. 3 shows a second embodiment of the invention.

The harness need not of course be permanently linked to a golf club at one end. In FIG. 3 a second embodiment of the aid is illustrated, the aid comprising a harness to which a glove 28 is fixed at one end to loop 17. Otherwise in FIG. 3, parts 11,12 and 14–17 are as described for the aid illustrated in FIG. 1.

Figure 4:
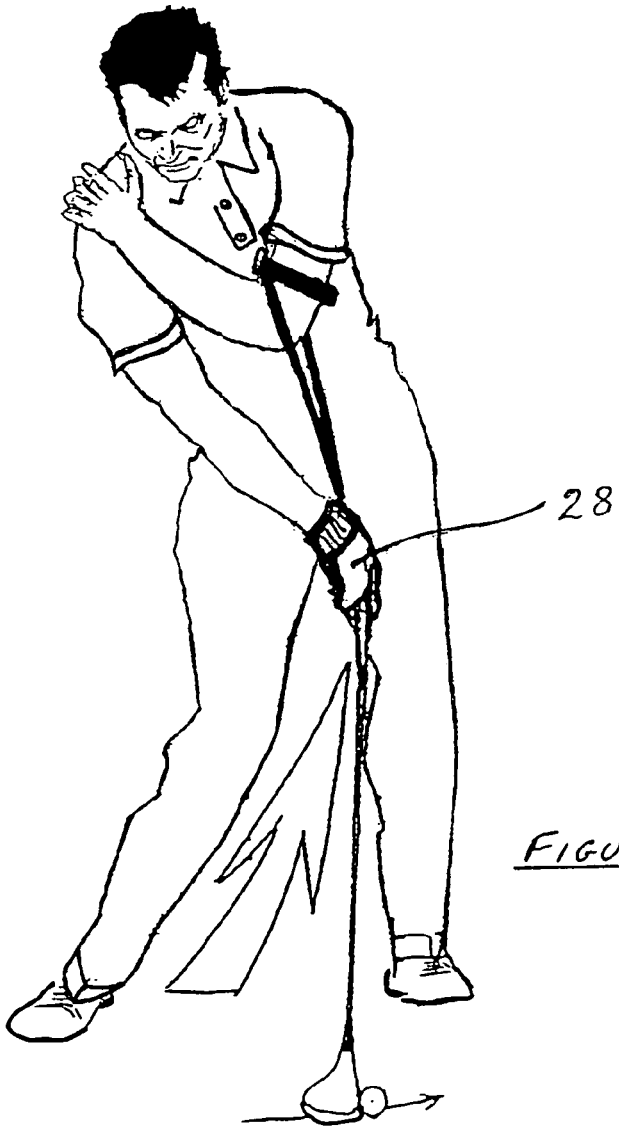
FIG. 4 shows the aid shown in FIG. 3, in use by a player playing right-handed.

The aid illustrated in FIG. 3 is used, by a player playing right-handed, as shown in FIG. 4. When the golfer has donned and adjusted the harness, as described for FIG. 2, and stabilised his left arm, he then puts on the glove 28 on his right hand and grips with his right hand, the handle of the club he wishes to use. This embodiment of the invention allows the golfer to switch easily from one club to another during practice sessions. The clubs used may be of conventional handle length, or foreshortened as described above.

The glove 28 will be made of conventional materials known to the skilled person, and may be strengthened around the point where it meets loop 17.

The golfer's stance, back swing, and down swing, using the aid will be conventional. He will use his right arm to torque the club back, down and into the impact with the ball. At the moment of impact, the club will still be moving along an essentially arcuate path. If he were to follow conventional teaching, and be swinging two-handed without any physical aid in place, he would try automatically to continue to torque the club straight through impact and into the follow-through of the swing.

This is where the invention differs from such conventional teaching in a radical manner. As the golfer approaches impact with the ball, the increasing tension in the elbow to club link forces the golfer into tending to"lift"the club head as it hits the ball. This lifting action imparts a strong radial acceleration to the club head which, at the moment of impact approaches a maximum, is directed in line with the tension in the elbow to club link, and is essentially at a right angle to the motion of the club head. This strong radial component of acceleration in the club head imparts a whip as the club head travels through ball impact, and this whip has been found in non-public experimental tests of the aid to improve dramatically the distances by which non professional golfers can drive the ball.

After repeated practice with the aid in this one-handed torque-restricting manner, golfers returning to the fairways having discarded the aid and playing"for real" will automatically continue to reproduce the strong radial component of acceleration to the club head at impact, and will see dramatic improvements in their driving distances.

In FIG. 2 the larger of the two arrows shows the essential direction of the lift component of this lift-and-torque action.

This same inherent tendency to impart a strong radial component of power to the club head at impact, imposed by practising with an aid of the kind illustrated, has similar benefits in sand bunker situations. Any watcher of pro-am golf tournaments will see that one of the immediate differences between the professional and the amateur is how they cope respectively with being bunkered. The amateur flails around usually several times before chipping out of the sand. But now his inherent and automatic tendency to lift the club head at impact with the ball will enable him to use his sand wedge to get out of the sand trap with no difficulty.

Although the aid has been described and illustrated for use as a teaching aid, any one-armed golfer who has an elbow joint will benefit from it overall. Whilst the rules might not allow him to play with the aid in place, his necessarily one-armed game will benefit from having practised with the aid in just the same way as a two-handed golfer can benefit if the aid is used correctly.

The embodiments specifically described and illustrated may be modified in a number of ways.

For example, loop 16 may be stitched onto loop 11 rather than (as illustrated) moving freely on it. This is so that once loop 11 has been strapped onto the upper arm, the position of loop 16 remains firmly fixed throughout the swing. It is then loop 12 that is free to move in both loop 16 and loop 17.

For completeness it should be explained that, in practice, the golfer would don the harness by hooking loop 12 over the inside apex of his left elbow (for a golfer playing right-handed) so that the tension in loop 12 is taken directly on the inner cleft of the elbow with loop 16 simply holding loop 12 firmly in place. But there are many different variations on the connection of the elbow-to-club link at the elbow. It is this link that is unique, not any given method of joining at the elbow.

The glove 28 could be a fingerless glove of the kind worn, for example, by racing cyclists or (more recently) rollerbladers. It might even be constituted by a wristband, only, within the broad scope of the invention-although in practice this may prove less effective than a fingered or fingerless glove which positively locates against at least the user's thumb-to-palm joint and hence effectively stabilises the elbow-to-club length as the club is swung against the ball.

Loop 17 in the gloved FIGS. 3/4 embodiment is located, on the extended inside wrist section of glove 28, sufficiently far away from the palm of the glove as not to interfere with a proper grip of the club handle in use.

The invention claimed is:

1. A golf swing training apparatus comprising:

a body fitting harness adapted to fix, in use, relative to one arm of a trainee using the apparatus;

elongate strap means, one end of which is attached to said harness means while the other opposite end of said strap means extends therefrom to hang, in use, adjacent a club-gripping hand of the other arm of said trainee; and means at said opposite end of said strap means, engageable by said club-gripping hand of said trainee to link the handle of a golf club gripped by said club-gripping hand to said opposite end of said strap means and hence, in use, to said one arm of said trainee;

said harness means comprising a strap-anchoring member including an armband so sized and shaped as to wrap tightly around said one arm of said trainee in the elbow region thereof; and the arrangement thereby permitting said trainee wearing said harness to first stabilize the position of said one arm by gripping, with the hand of said one arm, the shoulder region of said other arm and then, having gripped said club with the club-gripping hand of said other arm, propel said club in a one-hand swing whose arc is constrained by said strap means;

said strap means being flexible and loosely dangles from said armband when not in use;

said armband being so sized that it cannot be wrapped around the chest of the trainee;

said strap means being comprised of material with substantially no inherent stretch in its longitudinal direction and hence permits effectively no lengthwise extension of said strap means beyond its taut in-use state.

2. A golf swing training apparatus according to claim 1, wherein the means at said opposite end of said strap means includes a glove.

3. A golf swing training apparatus according to claim 1, when worn by the trainee with the armband wrapped tightly around said one arm of said trainee in the elbow region thereof, and said means at said opposite end of said strap means being engaged by said club-gripping hand of said trainee to link the handle of a golf club gripped by said club-gripping hand to said opposite end of said strap means and hence, in use, to said one arm of said trainee.

4. The combination of claim 3, wherein the means at said opposite end of said strap means includes a glove.

5. A method of using the golf swing training apparatus of claim 1, comprising the steps of wrapping the armband tightly around said one arm of said trainee in the elbow region thereof, and engaging said means at said opposite end of said strap means by said club-gripping hand of said trainee to link the handle of a golf club gripped by said club-gripping hand to said opposite end of said strap means and hence, in use, to said one arm of said trainee.

6. A method as set forth in claim 5, further comprising the step of the trainee gripping, with the hand of said one arm, the shoulder region of said other arm and then, having gripped said club with the club-gripping hand of said other arm, propelling said club in a one-hand swing whose arc is constrained by said strap means.

* * * * *